US007723908B2

(12) United States Patent
Krusos et al.

(10) Patent No.: US 7,723,908 B2
(45) Date of Patent: May 25, 2010

(54) FLAT PANEL DISPLAY INCORPORATING A CONTROL FRAME

(75) Inventors: Denis A. Krusos, Lloyd Harbo, NY (US); Frank J. DiSanto, North Hills, NY (US)

(73) Assignee: Copytele, Inc., Melville, NY (US)

( * ) Notice: Subject to any disclaimer, the term of this patent is extended or adjusted under 35 U.S.C. 154(b) by 0 days.

(21) Appl. No.: 11/484,889

(22) Filed: Jul. 11, 2006

(65) Prior Publication Data

US 2006/0290262 A1 Dec. 28, 2006

Related U.S. Application Data

(63) Continuation-in-part of application No. 10/974,311, filed on Oct. 27, 2004, now Pat. No. 7,327,080, which is a continuation-in-part of application No. 10/782,580, filed on Feb. 19, 2004, now Pat. No. 7,274,136, which is a continuation-in-part of application No. 10/763,030, filed on Jan. 22, 2004, now abandoned, which is a continuation-in-part of application No. 10/102,472, filed on Mar. 20, 2002, now Pat. No. 7,129,626.

(60) Provisional application No. 60/698,047, filed on Jul. 11, 2005, provisional application No. 60/715,191, filed on Sep. 8, 2005.

(51) Int. Cl.
*H01J 1/02* (2006.01)

(52) U.S. Cl. ..... 313/309; 313/495

(58) Field of Classification Search ..... 313/495–497, 313/309–311

See application file for complete search history.

(56) References Cited

U.S. PATENT DOCUMENTS

| | | | |
|---|---|---|---|
| 3,755,704 | A | 8/1973 | Spindt et al. |
| 5,177,406 | A | 1/1993 | Troxell |
| 5,214,347 | A | 5/1993 | Gray |
| 5,345,141 | A | 9/1994 | Moyer et al. |
| 5,541,478 | A | 7/1996 | Troxell et al. |
| 5,736,814 | A | 4/1998 | Kinoshita et al. |
| 5,955,850 | A | 9/1999 | Yamaguchi et al. |

(Continued)

FOREIGN PATENT DOCUMENTS

| | | |
|---|---|---|
| WO | WO 03/009057 | 1/2003 |

(Continued)

OTHER PUBLICATIONS

"Nano SU-8 Negative Tone Photoresist Formulations.2-25", Micro Chem, 4 pages, Rev. 2/02.

(Continued)

*Primary Examiner*—Bumsuk Won
(74) *Attorney, Agent, or Firm*—Plevy & Keene LLP

(57) ABSTRACT

A flat panel display including: a plurality of electrically addressable pixels; a plurality of thin-film transistor driver circuits each being electrically coupled to an associated at least one of the pixels, respectively; a passivating layer on the thin-film transistor driver circuits and at least partially around the pixels; a conductive frame on the passivating layer; and, a plurality of nanostructures on the conductive frame; wherein, exciting the conductive frame and addressing one of the pixels using the associated driver circuit causes the nanostructures to emit electrons that induce the one of the pixels to emit light.

20 Claims, 8 Drawing Sheets

U.S. PATENT DOCUMENTS

| | | | | |
|---|---|---|---|---|
| 6,023,126 | A | 2/2000 | Karpov | |
| 6,232,706 | B1 | 5/2001 | Dai et al. | |
| 6,590,320 | B1 | 7/2003 | Abanshin et al. | |
| 6,614,149 | B2 | 9/2003 | Kastalsky et al. | |
| 6,674,242 | B2 | 1/2004 | Kastalsky et al. | |
| 6,690,116 | B2 * | 2/2004 | Song et al. | 315/169.3 |
| 6,831,298 | B2 | 12/2004 | Park et al. | |
| 2002/0011777 | A1 * | 1/2002 | Konishi et al. | 313/495 |
| 2002/0079802 | A1 * | 6/2002 | Inoue et al. | 313/309 |
| 2002/0080099 | A1 * | 6/2002 | Song et al. | 345/75.2 |
| 2002/0134978 | A1 | 9/2002 | Kastalsky et al. | |
| 2002/0163287 | A1 * | 11/2002 | Cheng et al. | 313/309 |
| 2003/0057513 | A1 * | 3/2003 | Leedy | 257/506 |
| 2003/0090190 | A1 | 5/2003 | Takai et al. | |
| 2004/0058153 | A1 | 3/2004 | Ren et al. | |
| 2004/0222734 | A1 | 11/2004 | Oh | |

FOREIGN PATENT DOCUMENTS

| | | |
|---|---|---|
| WO | WO 03/069652 | 8/2003 |

OTHER PUBLICATIONS

K.B.K. Teo et al., "Uniform Patterned Growth of Carbon Nanotubes Without Surface Carbon", Applied Physics Letters, vol. 79, No. 10, pp. 1534-1536, Sep. 3, 2001.

C. J. Spindt et al, "9.2: ThinCRT Flat-Panel-Display Construction and Operating Characteristics", SID-98 DIGEST, pp. 99-102, 1998.

C.A. Spindt, "A Thin-Film Field-Emission Cathode", Journal of Applied Physics, vol. 39, No. 7, pp. 3504-3505, Jun. 1968.

Shoushan Fan et al., "Self-Oriented Regular Arrays of Carbon Nanotubes and Their Field Emission Properties", Science Magazine, vol. 283, pp. 512-514, Jan. 22, 1999.

Jaemyung,Kim et al. "Growth and Field Emission of Carbon Nanotubes on Electroplated Ni Catalyst Coated on Glass Substrates", Journal of Applied Physics, vol. 90, No. 5, pp. 2591-2594, Sep. 1, 2001.

Z. F. Ren et al., "Growth, Characterization, and Potential Applications of Periodic Carbon Nanotube Arrays", 2 pages.

Bingqing Wei et al., "Lift-Up Growth of Aligned Carbon Nanotube Patterns", Applied Physics Letters, vol. 77, No. 19, pp. 2985-2987, Nov. 6, 2000.

International Search Report dated Feb. 16, 2007 for related PCT Application No. PCT/US06/26760.

* cited by examiner

FLAT PANEL DISPLAY INCORPORATING A CONTROL FRAME

RELATED APPLICATIONS

This application claims the benefit under 35 U.S.C. 119 (e) of U.S. Provisional Applications Nos. 60/698,047, filed Jul. 11, 2005 and 60/715,191, filed Sep. 8, 2005, the entire disclosures of each of which are all hereby incorporated by reference herein. This application also claims priority to as a continuation-in-part of U.S. patent application Ser. No. 10/974,311 entitled "Hybrid Active Matrix Thin-Film Transistor Display," filed on Oct. 27, 2004 now U.S. Pat. No. 7,327,080, which is a continuation in part of U.S. patent application Ser. No. 10/782,580 entitled "Hybrid Active Matrix Thin-Film Transistor Display", filed on Feb. 19, 2004 now U.S. Pat. No. 7,274,136, which is a continuation in part of U.S. patent application Ser. No. 10/763,030, entitled "Hybrid Active Matrix Thin-Film Transistor Display, filed on Jan. 22, 2004 now abandoned, which is a continuation in part of U.S. patent application Ser. No. 10/102,472, entitled "Pixel Structure For An Edge-Emitter Field-Emission Display, filed on Mar. 20, 2002 now U.S. Pat. No. 7,129,626.

FIELD OF THE INVENTION

This application is generally related to the field of displays and more particularly to flat panel displays using Thin Film Transistor (TFT) technology.

BACKGROUND OF THE INVENTION

Flat panel display (FPD) technology is one of the fastest growing display technologies in the world, with a potential to surpass and replace Cathode Ray Tubes (CRTs) in the foreseeable future. As a result of this growth, a large variety of FPDs exist, which range from very small virtual reality eye tools to large hang-on-the-wall television displays.

It is desirable to provide a display device that exhibits a uniform, enhanced and adjustable brightness with good electric field isolation between pixels. Such a device would be particularly useful as a FPD.

SUMMARY OF THE INVENTION

A flat panel display comprising: an anode comprising: a plurality of electrically addressable pixels; a plurality of thin-film transistor (TFT) driver circuits each being electrically coupled to an associated at least one of the pixels, respectively; a passivating layer on the thin-film transistor driver circuits and at least partially around the pixels; and, a conductive frame on the passivating layer; and, a cathode; wherein, exciting the conductive frame and addressing one of the pixels using the associated driver circuit causes the cathode to emit electrons that induce the one of the pixels to emit light.

BRIEF DESCRIPTION OF THE DRAWINGS

It is to be understood that the accompanying drawings are solely for purposes of illustrating the concepts of the invention and are not drawn to scale. The embodiments shown in the accompanying drawings, and described in the accompanying detailed description, are to be used as illustrative embodiments and should not be construed as the only manner of practicing the invention. Also, the same reference numerals have been used to identify similar elements.

DETAILED DESCRIPTION OF THE INVENTION

Figure 1:
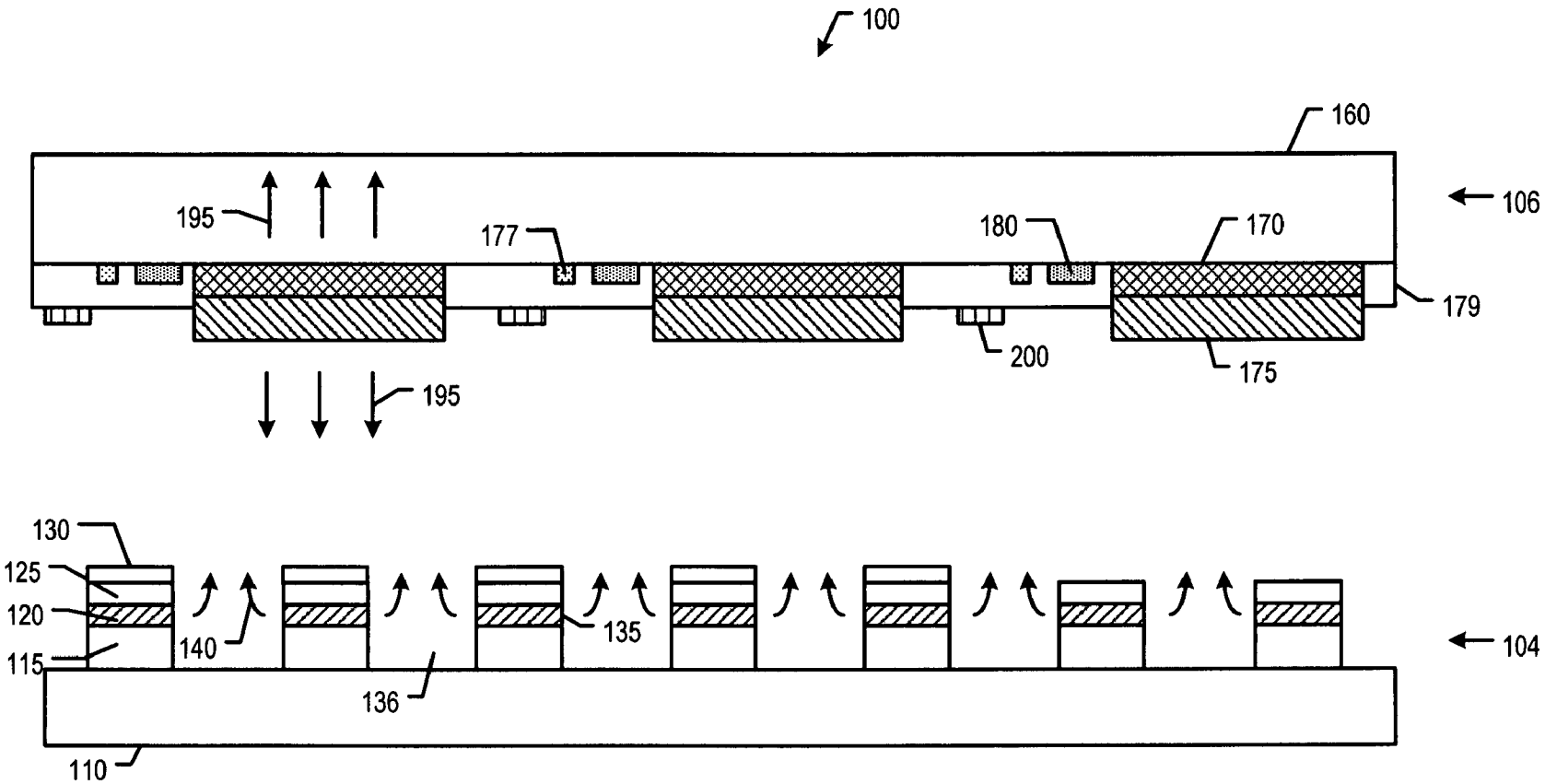
FIGS. 1-3 illustrate exemplary display devices according to different embodiments of the present invention.

It is to be understood that the figures and descriptions of the present invention have been simplified to illustrate elements that are relevant for a clear understanding of the present invention, while eliminating, for the purpose of clarity, many other elements found in typical FPD systems and methods of making and using the same. Those of ordinary skill in the art may recognize that other elements and/or steps are desirable and/or required in implementing the present invention. However, because such elements and steps are well known in the art, and because they do not facilitate a better understanding of the present invention, a discussion of such elements and steps is not provided herein.

Before embarking on a more detailed discussion, it is noted that passive matrix displays and active matrix displays are types of FPDs that are used extensively as various display devices, such as in laptop and notebook computers, for example. A passive matrix display utilizes a matrix or array of solid-state elements, where each element or pixel is selected by applying a potential voltage to corresponding row and column lines that form the matrix. An active matrix display further includes at least one transistor and capacitor that is also selected by applying a potential to corresponding row and column lines.

According to an embodiment of the present invention, each pixel element includes a phosphor pad, which emits light of a known wavelength when struck by emitted electrons, and an associated TFT circuit. A thin-film-transistor (TFT) is a type of field effect transistor (FET) having thin films as metallic contacts, a semiconductor active layer and a dielectric layer. TFT's are widely used in liquid crystal display (LCD) FPDs. In one embodiment of the present invention, each TFT circuit includes first and second active devices electrically cascaded and a capacitor in communication with an output of the first device and an output of the second device, that is used to selectively address pixel elements in the display. Various electron emission sources may be used with such a pixel and TFT circuit array.

According to an embodiment of the present invention, a control frame surrounds at least some of the pixels and associated TFT circuits in the array. In one configuration, the control frame surrounds each of the pixels and associated TFT circuits in the array. Such a control frame may typically lead to an improved display uniformity, brightness and electric field isolation between pixels, regardless of the type of electron source used, as compared to a comparable construct not incorporating the control frame. The control frame may be disposed in an inactive area of the array of pixels and associated TFT circuits, such as between the pixels (e.g., on an insulating substrate over respective column and row conductors).

The control frame enables display operation at low voltages, such as a maximum voltage of less than around 40 volts. Such a configuration is well suited for being operated as a flat display device. Further, incorporating a control frame enables a much simpler production method than that associated with prior art configurations, that utilize "suspended" or elevated grid structures. For example, the control frame may be applied lithographically as the final layer to the TFT device.

Referring now to FIG. 1, there is shown a schematic cross-section view of a TFT anode/cold cathode Field Emission Display (FED) 100 according to an embodiment of the present invention. In this exemplary embodiment, the display 100 includes cathode 104 that acts as a low-voltage source of electrons, and anode 106 that employs TFT circuitry to control the attraction of electrons 140.

Anode 106 includes a plurality of conductive pads 170 fabricated in a matrix of substantially parallel rows and columns on a substrate 160 using known fabrication methods. Column conductors 177 are associated with each of the corresponding conductive pads 170. In this illustrated embodiment substrate 160 is a transparent material such as glass. Conductive pads 170 are also composed of a transparent material, such as ITO (Indium Titanium Oxide). It is of course recognized that the pixels may range from opaque to transparent according to the desired application and/or viewing perspective.

Deposited on each conductive pad 170 is phosphor layer 175. Phosphor layer 175 may be selected from materials that emit light 195 of a specific color. In a conventional RGB display, phosphor layer 175 may be selected from materials that produce red light, green light or blue light 195 when struck by electrons 140. As will be appreciated by those skilled in the art, the terms "light" and "photon" are used synonymously and interchangeably herein. A matrix organization of conductive pads and phosphor layers allows for X-Y addressing of each of the individual pixel elements in the display will be understood by one skilled in the pertinent arts.

Associated with each conductive pad 170/phosphor layer 175 pixel is a TFT circuit 180 that applies a known voltage to the associated conductive pad 170/phosphor layer 175 pixel. For example, TFT circuit 180 operates to apply either a first voltage to bias an associated pixel element to maintain it in an "off" state or a second voltage to bias an associated pixel element to maintain it in an "on" state, or an intermediate state. In this illustrated case, conductive pad 170 is inhibited from attracting electrons 140 emitted by cathode 104 when in an "off" state, and attracts electrons 140 when in an "on" state or an intermediate state.

The use of TFT circuitry 180 for biasing conductive pad 170 provides the dual function of addressing pixel elements and maintaining the pixel element in a condition to attract electrons for a desired time period, i.e. time-frame or sub-periods of time-frame. Co-pending patent application Ser. No. 10/782,580 entitled "Hybrid Active Matrix Thin-Film Transistor Display" filed on Feb. 19, 2004 and assigned to Copytele, Inc. the assignee, describes various TFT, anode, and cathode configurations useful in implementing the present invention, the subject matter thereof incorporated by reference herein in its entirety. In the illustrated embodiment, a control frame 200 is disposed on a passivation layer 179 of anode 106 and surrounds each of the pixel elements 170/175.

Cathode 104 is fabricated by progressively depositing onto substrate 110, conventionally a glass, an insulating material 115, such as $SiO_2$, an edge emitter material 120 operable to emit electrons, a second insulating layer 125, such as $SiO_2$, and a second conductive material 130, such as Mo. Emitter material 120 may be selected from known materials that have a low work function for emitting electrons 140. Emitter material 120 may comprise a metal such as Molybdenum, for example. Wells 136 are formed through the deposited second conductive layer 130, insulating layer 125, emitter layer 120, and insulating layer 115 using well-known techniques, such as photo-etching. In this case, edges 135 of emitter material 120 are exposed and generate electrons 140 under excitation. Second conductive material 130 operates as a gate electrode to draw electrons 140 from the edges of emitter material 120 when a sufficient potential difference exists between conductive material 130 and emitter layer 120.

Figure 2:
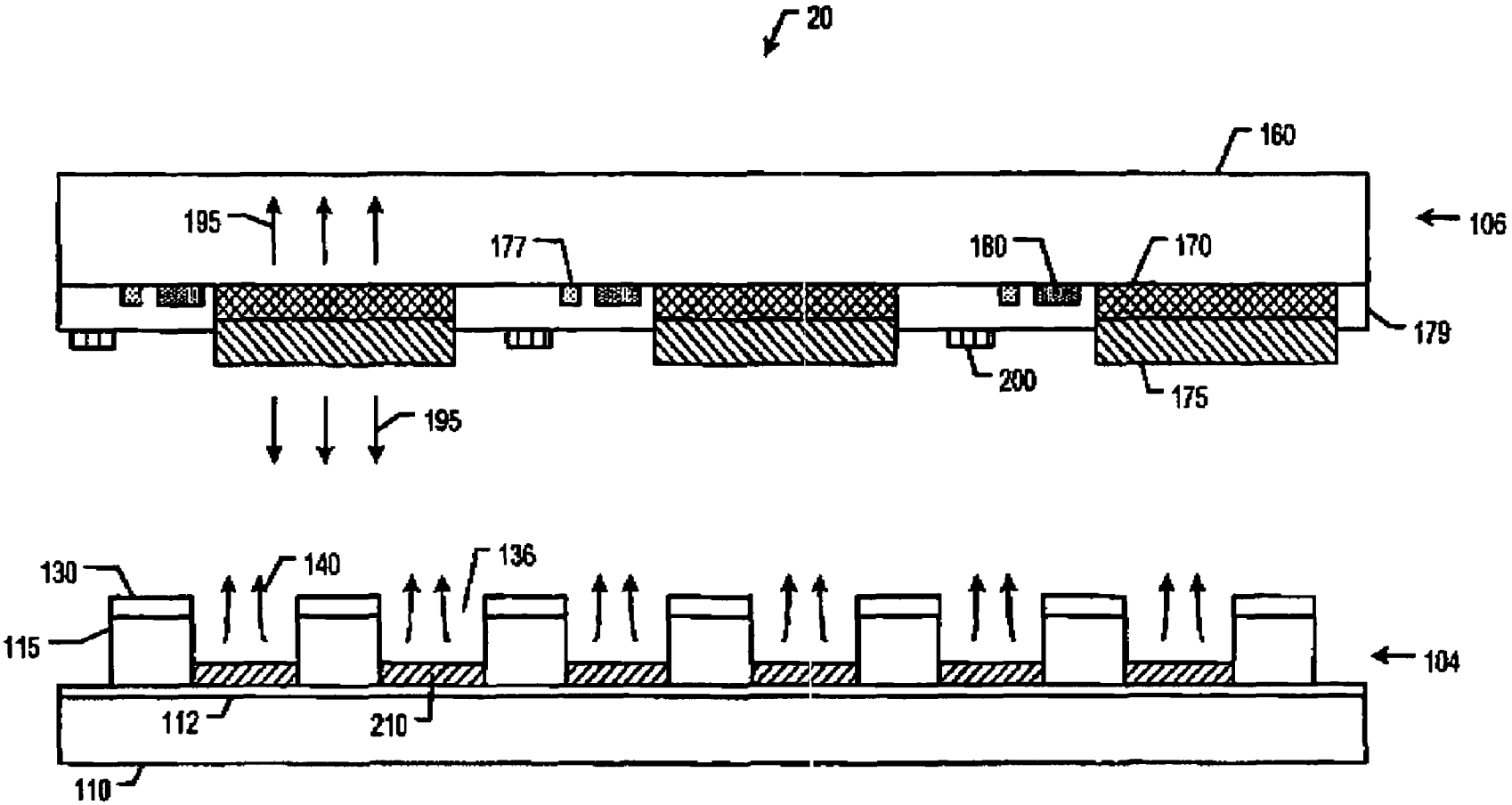

Referring now also to FIG. 2, there is shown a display 20 according to another embodiment of the present invention. Elements in common with the embodiment of FIG. 1 will not be described again. Display 20 does not incorporate edge emitters, but includes a surface emitter layer 210. Emitter layer 210 is separated into wells 136 by insulator layer 115. Insulator layer 115 may be deposited onto substrate 110 and etched in a conventional manner to form wells 136.

Figure 3:
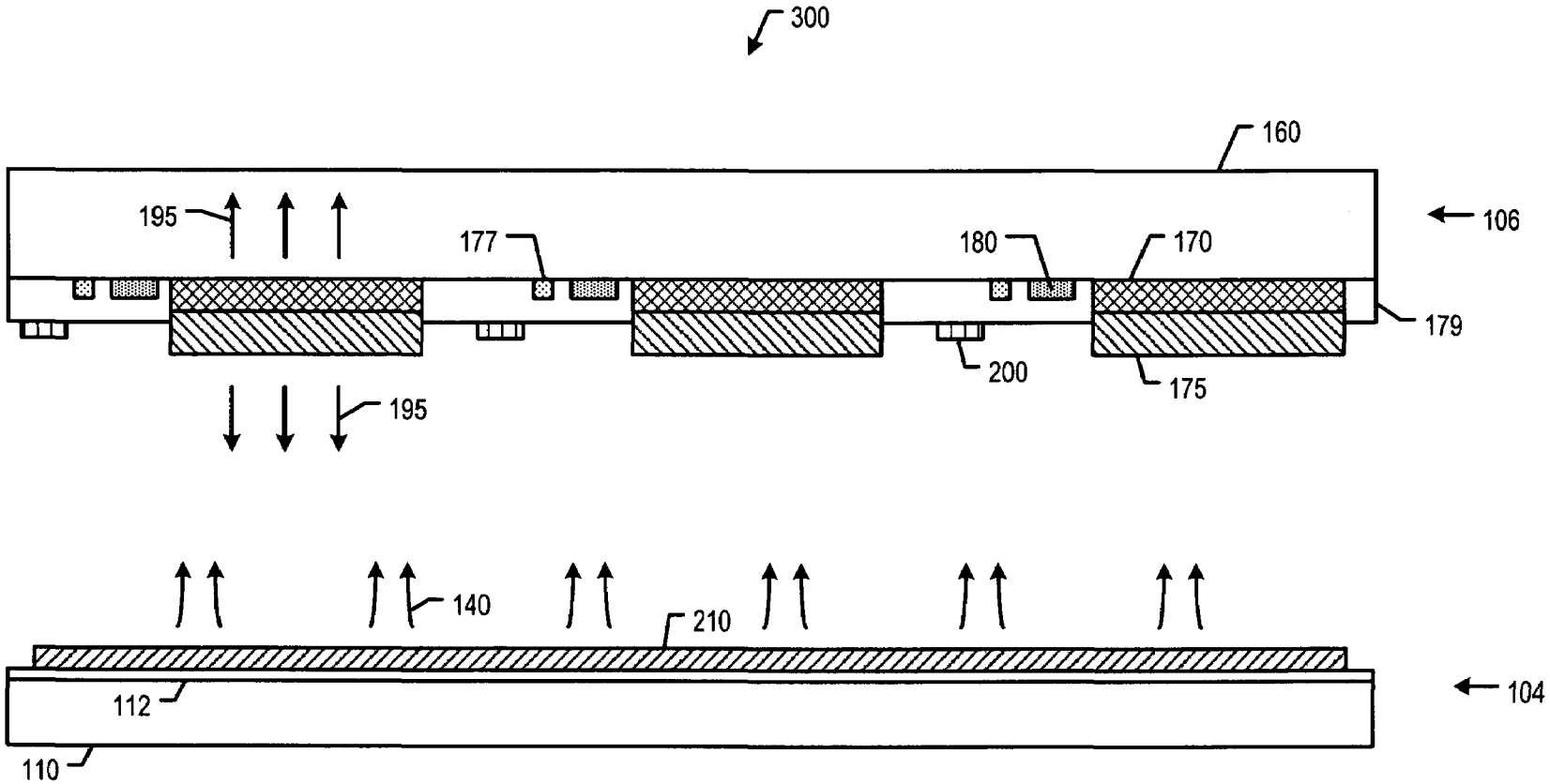

Referring now also to FIG. 3, there is shown a display 300 according to another embodiment of the present invention. Elements in common with the embodiment of FIG. 2 will not be described again. Differently however, display 300 does not incorporate layer 115.

Referring now to FIGS. 2 and 3, emitter layer 210 may take the form of any electron emitter material having a suitably low work function, such as a layer incorporating electron emitting structures upon a conductive surface or layer 112. Suitable candidates for selection as electron emitters include layers having nano- and/or micro-structures, for example.

The nanostructures may take the form of carbon nanotubes, for example. The nanostructures may take the form of single-wall carbon nanotubes (SWNTs) and/or multiple wall carbon nanotubes (MWNTs). The nanostructures may be applied to substrate 110 using any conventional methodology, such as spraying, growth, electrophoresis or printing, for example.

By way of further non-limiting example only, where substrate 110 takes the form of a glass surface 112 may be metalized with Mo. Electrophoresis may then be used to apply nanotubes to the metalized surface 112 of substrate 110. For example, about 5 mg of commercially available carbon nanotubes may be suspended in a mixture of about 15 mL of Toluene and about 0.1 mL of a surfactant, such as polyisobutene succinamide (OLOA 1200). The suspension may be shaken in a container with beads for around 3-4 hours. Thereafter, the metalized surface 112 of substrate 110 may be immersed in the shaken suspension, while applying a DC voltage to the metalized surface 112 that is positive relative to a suspension electrode (where the nanotubes have a relatively negative charge).

Figure 4:
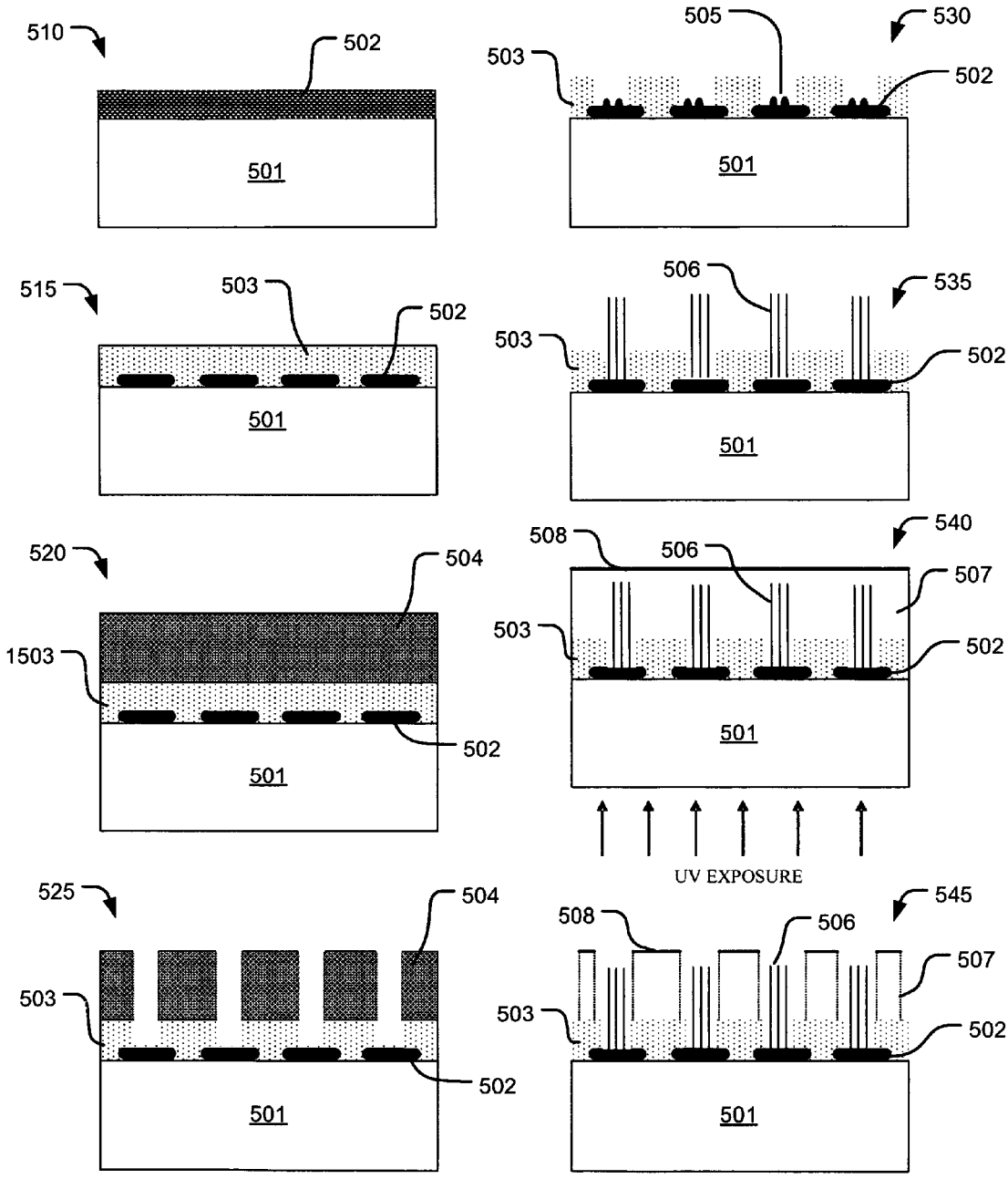
FIGS. 4-6 illustrate processes for forming cathodes useful in implementing display devices according to embodiments of the present invention.

Alternatively, the nanotubes may be self-assembled. Referring now also to FIG. 4, there is shown a series of processing steps. Referring first to step 510, there is shown a substrate 501 having a coating 502. Substrate 501 may take the form of any conventional substrate suitable for supporting the cathode of FIG. 2 or 3. In certain embodiments, it may be desirable that the substrate and coating appear transparent to a user, where an image is to be viewed through substrate 501 and coating 502. Substrate 501 may take the form of a glass substrate. Coating 502 may take the form of chromium. Coating 502 may be about 100 nm thick. A resist coating may be spun onto coating 502. The resist may be patterned, such as by photolithographic processing, to provide alternating rows of photo-resist and exposed chromium that will correspond to rows of gate electrodes and wells as has been described with regard to FIG. 2. The chromium may then be etched to remove the exposed portions.

Referring now also to step 515, a layer 503 of $SiO_x$, such as $SiO_2$, may be deposited onto the patterned coating 502. Layer 503 may be at least about 0.1 μm thicker than coating 502, to provide for insulation between what will become the cathode conductors and gate electrodes. Referring now also to step 520, a positive resist layer 504, such as photo-resist, may be spun coat onto layer 503. Layer 504 may be about 1 μm thick, for example. Layer 504 may be patterned, again using photolithographic techniques for example, to provide openings roughly aligned with the remaining portions of layer 502. The patterned openings may be slightly smaller than the remaining portions of layer 502, by way of non-limiting example.

Referring now also to Step 525, patterned or exposed portions or regions of layer 503 may be removed, such as by buffered HF selective etching for example, to reveal at least portions of the remaining layer 502.

Referring now also to Step 530, a catalytic layer 505 may be deposited onto the exposed portions of layer 502. Catalytic layer 505 may include iron, cobalt or nickel, by way of non-limiting example only. Layer 505 may be substantially uniform or may be patterned for example. By way of further non-limiting example only, layer 505 may be deposited using amplitude and duration controlled pulse-current electrochemical deposition to form nanoparticles on layer 502. Formed nano-particles may typically be less than about 1.00 nm in size. The formed nanoparticles may have a density between about $10^6$ and $10^8/cm^2$.

Referring now also to Step 535, nanostructures 506 may be formed on catalytic layer 505. Nanostructures 506 may take the form of self aligned arrays of carbon nanotubes. Nanotubes may be formed on catalytic layer 505 using any suitable methodology, such as that described in U.S. patent Publication No. 20040058153, the entire disclosure of which is hreby incorporated by reference herein.

Referring now also to Step 540, a resist coating layer 507, such as a 10 μm thick layer of SU-8 photo-resist, may be spun over nanostructures 506 and layer 503—to provide a standoff distance for the gate electrodes. Resist layer 507 may then be exposed, such as to UV through substrate 501. A post exposure baking step may also be effected. A metallization layer 508 may be deposited upon layer 507. Metallization layer 508 may be composed of chromium, for example. Layer 508 may form gate electrodes 130 (FIG. 130) and be about 50 nm thick, for example.

Figure 5:
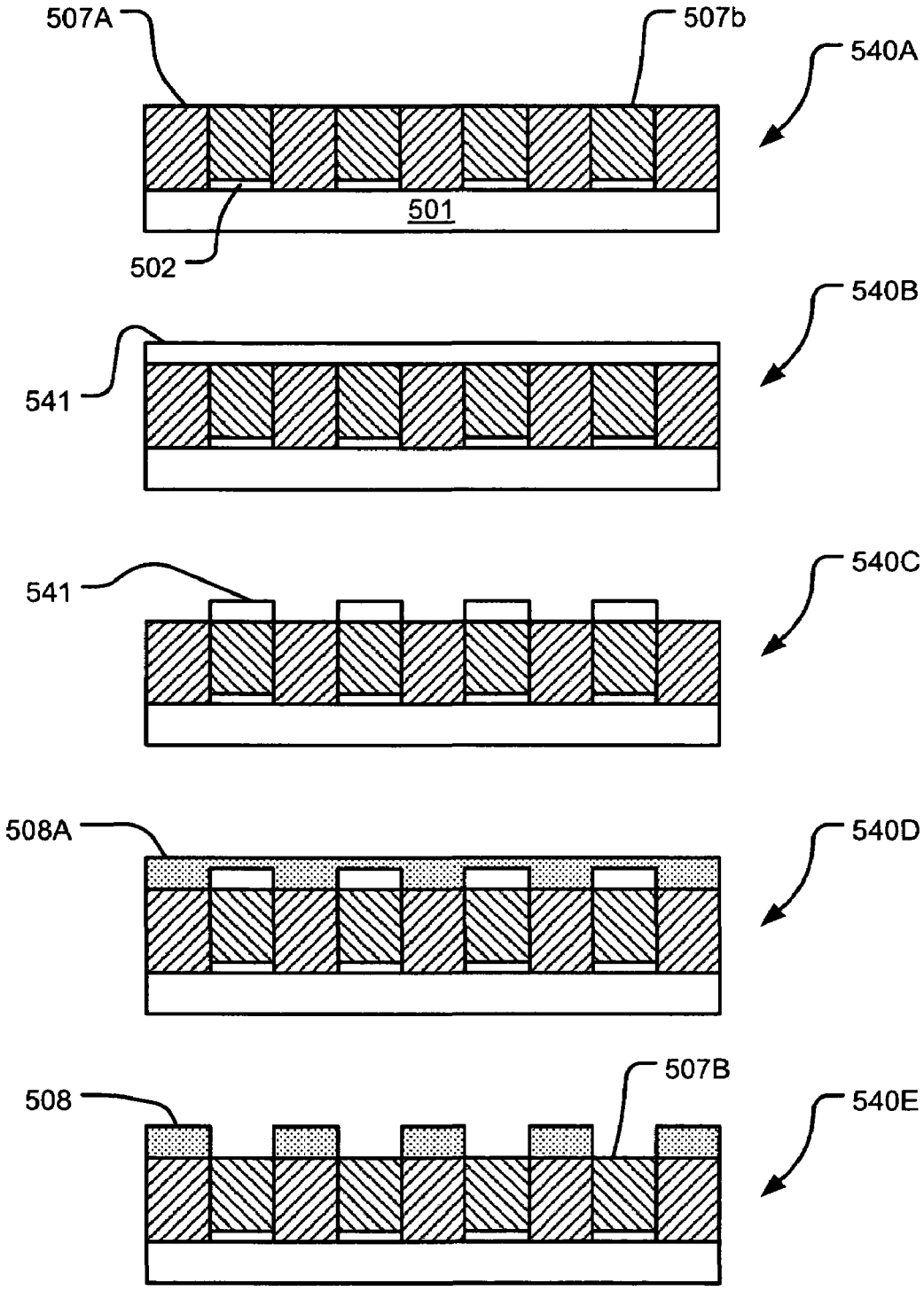

Referring now also to FIG. 5, there is shown a process for gate formation suitable for use with process 500. Steps 540A-540E may provide for step 540. In step 540A, there is shown substrate 501, layer 502 patterned in conductive islands and resist layer 507. Emitting structures, such as nanotubes, may already be formed on the patterned islands of coating 502. Resist layer 507 may take the form of SU-8 photoresist. Layer 507 may be exposed through substrate 501 to yield cross-linked SU-8 regions 507A and non-cross-linked regions 507B. As will be understood by those possessing an ordinary skill in the pertinent arts, the positioning of regions 507A and 507B is dependent upon patterned coating 502, as layer 507 is cured through the substrate such that patterned coating 502 serves as a mask.

Referring now also to step 540B, a layer 541 of photo-resist may be deposited onto the construction of step 540A. The photo-resist of layer 541 may have improved lift-off operability as compared to the resist of layer 507. Layer 541 may be composed of 1805 photo-resist, for example. The 1805 photo-resist may be spun onto the construct of step 540A. Referring now also to step 540C, layer 541 may be back-exposed and developed, and thereby patterned. Again, as will be understood by those possessing an ordinary skill in the pertinent arts, via back-exposing the pattern of layer 541 is dependent upon the pattern of conductive islands of layer 502.

Referring now also to step 540D, a metallization layer 508A may be deposited over the construct of step 540C. Layer 508A may be composed of chromium, for example. Referring now also to step 540E, the construct of step 540D may then be subjected to a lift-off process, such as through the use of a developer like MF-319 or acetone—thereby providing metallization layer 508.

Referring again to FIG. 4, and now to step 545, layer 507 (507B in FIG. 5) may be developed to expose nanostructures 506. The composite structure may then be hard baked.

Processing consistent with that described with reference to FIGS. 4 and 5 provides a composite structure having chromium gate electrodes (layer 508) upon hard baked SU-8 photo-resist standoffs (layer 507) and nanostructures (layer 506) upon chromium layer (502) within wells between gate electrodes. The wells in the SU-8 layer (507) may be wider than the exposed chromium stripes thus providing insulation and serving to mitigate a risk of shorts and leaks as the edges of the chromium stripes are covered by $SiO_x$ (layer 503).

Figure 6:
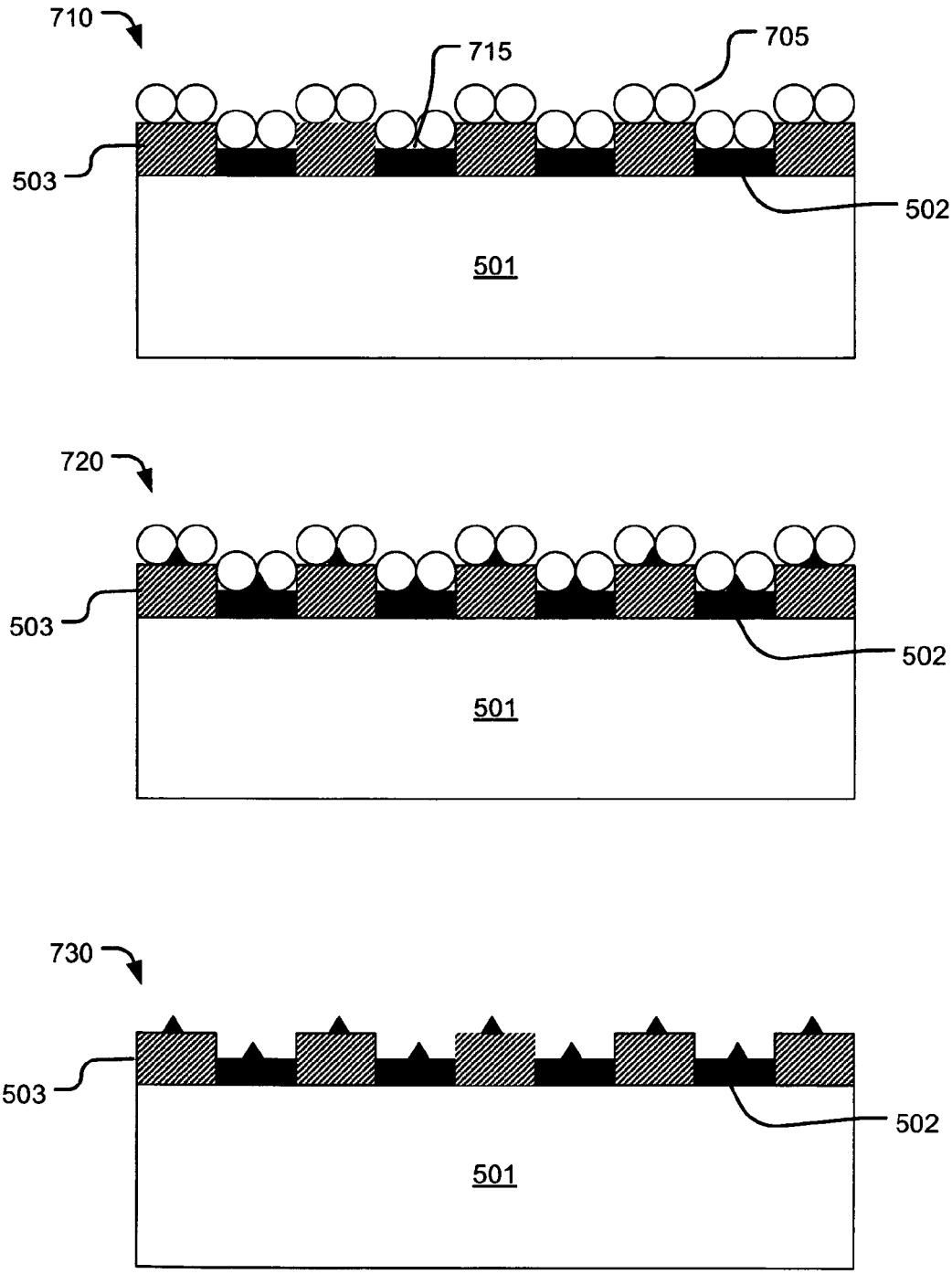

Alternatively, the emitting structures may take the form of tip emitters. Referring now also to FIG. 6, there is shown an alternative processing according to an embodiment of the present invention. To utilize the processing of FIG. 6, after step 525 (FIG. 4), processing may proceed as follows. Referring now to step 710, a layer of nanoparticles 705 may be deposited upon layers 502, 503. Layer 705 may take the form of a monolayer of nanospheres. The spheres may be about 2 μm in diameter, for example. The spheres may be largely composed of polystyrene, for example. Layer 705 may be formed using any conventional technique. Layer 705 forms open spaces 715, in a hexagonal pattern, for example. The density of the open spaces may be controlled through the use of additional monolayers of spheres, for example. According to an aspect of the present invention, the density of spaces may be about $10^5/cm^2$ to about $10^9/cm^2$, or around about $10^6/cm^2$.

Referring now to step 720, a catalyst, such as nickel, may be deposited or sputtered over the layer 705, such that it coats the spheres of layer 705 and spaces 715. Referring now also to step 730, layer 705 may then be dissolved or selectively removed. This may be accomplished using a solvent that does not attack either Cr or Ni, such as Toluene. Processing may then proceed as shown in FIG. 4, commencing with Step 535.

Figure 7:
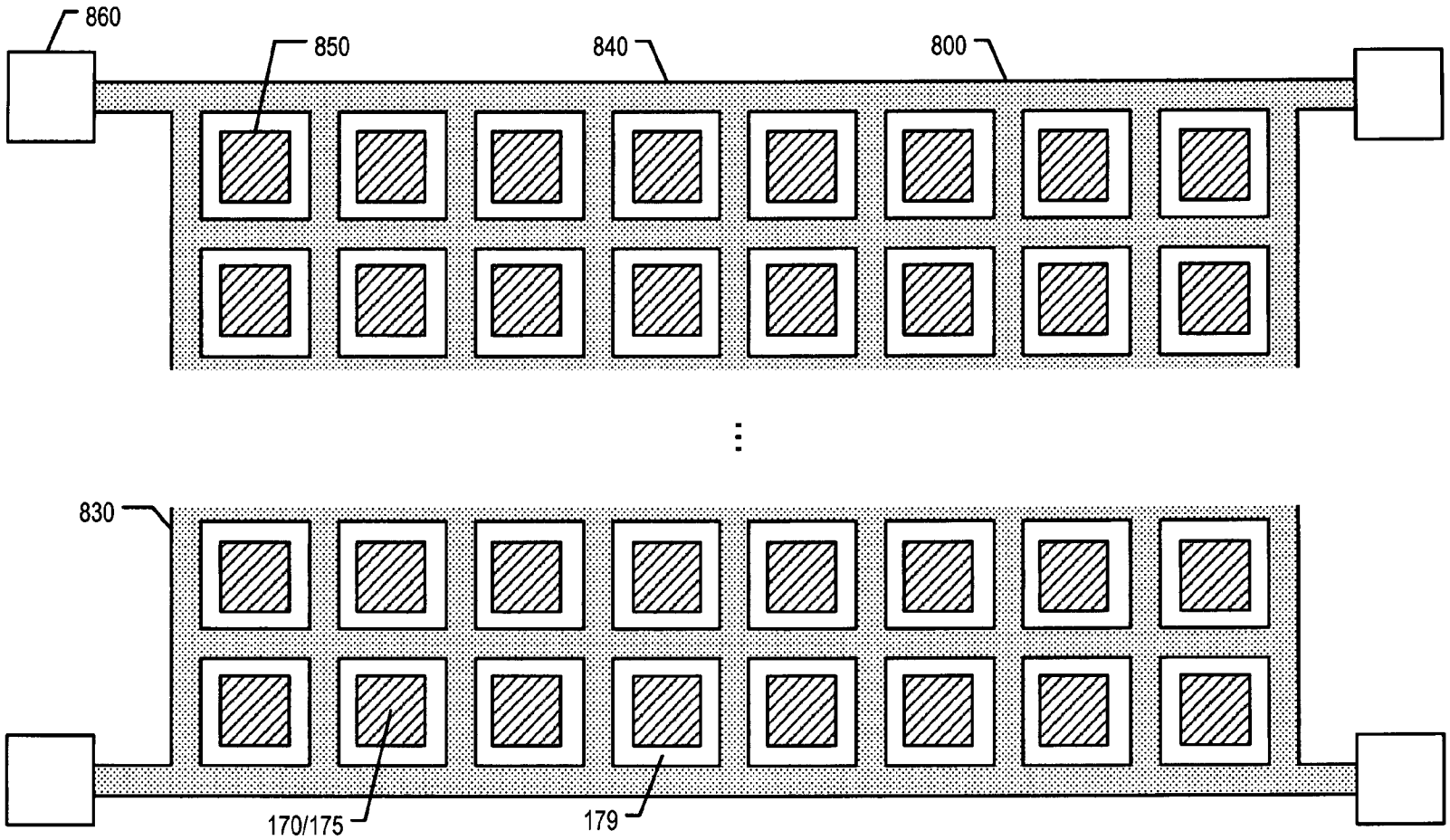
FIG. 7 illustrates a control frame according to an embodiment of the present invention; and, FIG. 8 illustrates a driving circuit according to an embodiment of the present invention.

Referring now also to FIG. 7, there is shown a plan view of a control frame 800 suitable for use as control frame 200 (FIGS. 1-3). Control frame 800 includes a plurality of conductors arranged in a rectangular matrix having parallel vertical conductive lines 830 and parallel horizontal conductive lines 840, respectively. Each pixel 170/175 is bounded by vertical and horizontal conductors or lines 830, 840, such that the conductors substantially surround each pixel 170/175 to the right, left, top, and bottom. One or more conductive pads 860 electrically connect conductive frame 800 to a conventional power source. In the illustrated embodiment of FIG. 8, four conductive pads 860 are coupled to the conductive lines 830, 840 of frame 800. In an exemplary embodiment, each pad 860 is around 100×200 micrometers (microns) in size.

The control frame 800 serves as a metal layer above the TFT final passivation layer 179 (see e.g. FIG. 1). Using a mask, the control frame may be formed using the conventional method of imaging the desired structure on a photoresist layer which is placed on a metal layer, above the passivation layer, and then etching. A lift-off technique may also be employed.

The pads 860 and metal conductors that form control frame 800 should remain free from passivation. In an exemplary configuration, the control frame metal layer has a thickness of less than about 1 micrometer (μm), although it is understood that other thicknesses may be used depending on the particular application. An appropriate voltage applied to the control frame prevents appearance of mutual field effects on neighboring pixels, and thus enables a more uniform and greater brightness of each individual pixel. Prior art configurations are susceptible to the effects of undesirable electric fields between pixels, particularly when control voltages are operated to activate one pixel ("high") while a neighboring pixel is inactive ("low"). The exemplary control frame 800 operates as a shield to suppress such undesirable electric fields between pixel structures and better isolate and stabilize each of the pixels.

Figure 8:
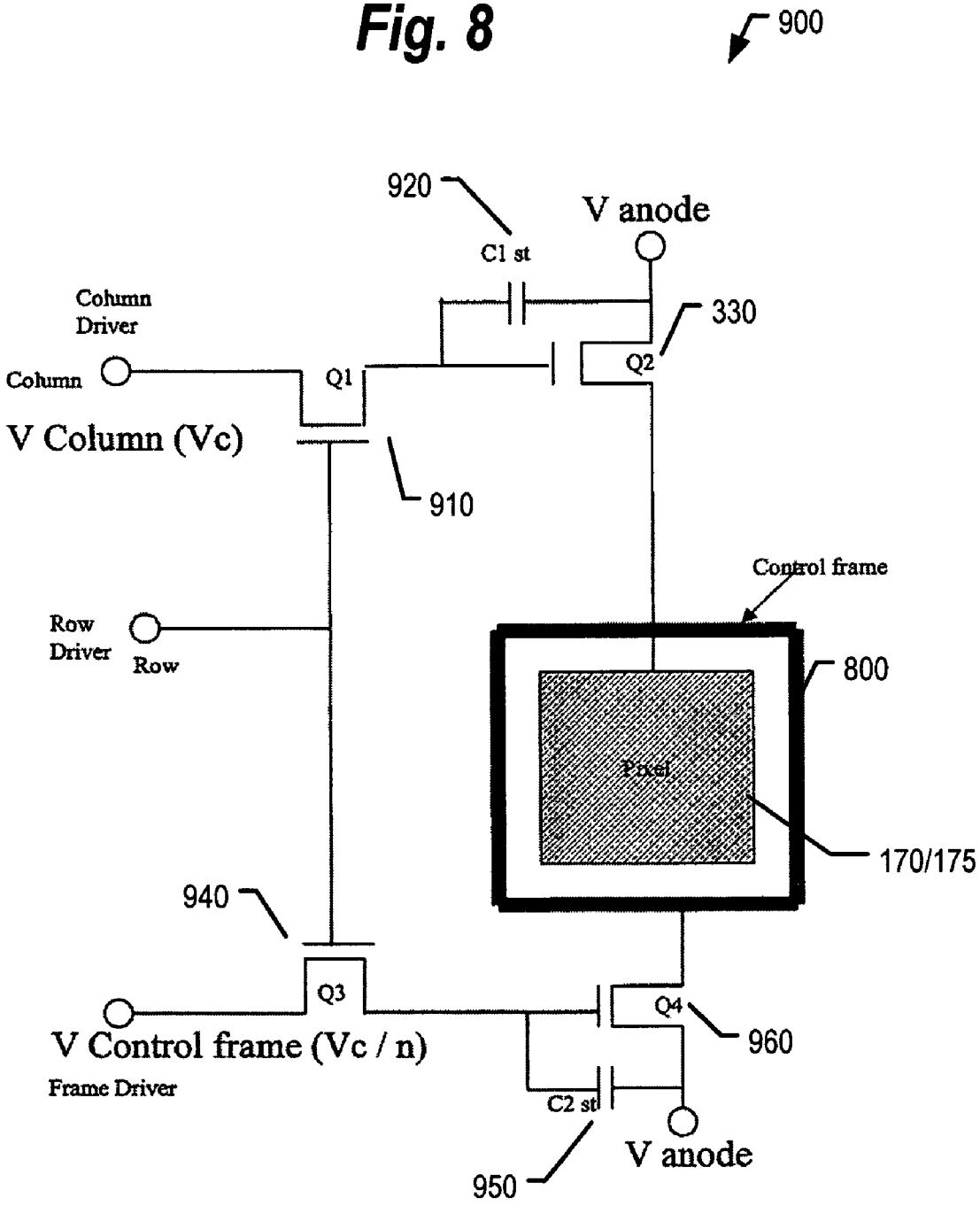

In one embodiment of the present invention, the vertical line conductors 830 and horizontal line conductors 840 are framing each pixel 170/175 and are above the plane of the pixels 170/175. However, it is understood that other configurations are contemplated where the conductors are disposed in the same plane as the pixels. Further, the conductors 830 and 840 may be connected in a number of configurations. For example, in one configuration, all horizontal and vertical conductors are joined together as shown in FIG. 8 and a voltage is applied to the entire control frame configuration. In another configuration, all horizontal conductors 840 are joined and separately all vertical conductors 830 are joined. In this connection configuration the horizontal conductors and the vertical conductors are not electrically connected. In yet another configuration a voltage is applied to the horizontal conductor, and a separate voltage is applied to the vertical conductor. In another configuration the control frame voltage is applied to a pixel surrounded by a vertical and horizontal conductor which is independent of voltage on other pixels.

Other configurations are also contemplated, including for example, a configuration of all horizontal conductors only, or a configuration of all vertical conductors only. In these configurations, the device shields the pixels from undesirable electric fields in only one direction.

A control frame voltage of about one half the corresponding anode voltage has been found to produce good brightness and uniformity conditions, however, other voltages may be employed to optimize other aspects and features of the TFT based display, such as contrast, gray scale, and color combinations, for example. The anode voltage of each pixel determines the brightness or color intensity of each pixel. In order to enable greater control with respect to gray scale and/or color combinations, it may be desirable to change the control frame voltage of each pixel depending on an applied characteristic, such as the data amplitude applied to that pixel.

According to an aspect of the present invention, control of one or more of the pixels may be accomplished using the circuit 900 of FIG. 8. Circuit 900 includes first and second transistors 910, 930 and capacitor 920 electrically interconnected with a pixel, e.g., pad 170, FIG. 1. Third and fourth transistors 940, 660 and a second capacitor 950 may be used to generate a control frame voltage which is equal to the column voltage (Vc) divided by a ratio factor (n). The factor (n) may be selected to produce the good results for a particular application. In an exemplary operation, data may be provided via the column driver (Vc) to produce an amplitude signal. If a predetermined amount (e.g., half) of the voltage of that signal is to be applied to the frame at the same time, then (n) equals 2. The control frame driver (Vc/n) thus applies to the control frame one half of the voltage as is applied at the corresponding particular pixel. The structure is driven using the same row driver (row) such that when a given row N (e.g., row 1-234, FIG. 1) is turned on, the corresponding pixel N (e.g., pixel 1 of row 1) receives a voltage from the column driver, and the control frame around pixel 1 receives a voltage from the control frame driver which is a fraction of the voltage across pixel 1. When pixel 2 is turned on, the corresponding control frame surrounding that pixel (i.e. the control frame surrounding pixel 2) receives a control frame voltage that is a fraction of the column driver voltage appearing at pixel 2. Thus, for each column N (e.g., where n equals 960 columns), there exists a corresponding n equal to 960 frames, where each frame receives a control voltage each time the corresponding pixel associated with that control frame receives an applied column driver voltage. Storage, capacitors 920 and 950 operate to hold the charge on each of the pixel and the control frame for a period of time, such as for an entire frame. When processing proceeds to the next row (e.g., row 2), the row 1 pixels are still drawing current. In this manner, capacitor 950 "remembers" the frame voltage when proceeding from one row to the next (e.g., from the first row to the second row) while capacitor 930 "remembers" the pixel voltage when going to the next row. Such processing operations continue through the entire frame.

In general, the row voltage is used to select the row is equal to the fully "on" voltage (Vc) of the column. The voltage Row in this case causes the pass transistor 910 to conduct. The resistance of transistor 910, the capacitor 920 and the write time of each selected row determines the voltage at the gate of transistor 930 as compared to Vc. Using a row voltage higher than the fully "on" voltage (Vc) increases the conduction of transistor 910, reducing its resistance and resulting in an increase in pixel voltage and enhanced brightness. The same advantage will also apply to the control frame voltage applied to transistors 940, 960. Thus, the selection voltage for the row is higher than the highest column voltage, thereby causing the transistors 910, 930 to conduct with a reduced resistance, thereby providing a greater voltage on the gates of transistors 940, 950.

It is further understood that other circuit configurations may also be utilized. For example, the voltage applied to the control frame structure around each pixel may also be generated by using a voltage divider circuit at each pixel which produces a voltage which is proportional to the pixel voltage.

As discussed, the control frame configuration associated with the present invention is particularly well suited for flat CRT display technology, although not limited thereto. In an exemplary embodiment, a display element is composed of a cathode that acts as a low-voltage source of electrons, and an anode that employs TFT technology to control the attraction of electrons to corresponding pixel elements on a surface of a display, and the control frame 200 surrounding the pixels elements as discussed above.

It is expressly intended that all combinations of those elements that perform substantially the same function in substantially the same way to achieve the same results are within the scope of the invention. Substitutions of elements from one described embodiment to another are also fully intended and contemplated.

What is claimed is:

1. A flat panel display comprising:

an anode comprising:

a plurality of electrically addressable pixels;

a plurality of addressing conductors;

a plurality of thin-film transistor (TFT) driver circuits each being electrically coupled to an associated at least one of said pixels and at least one of said addressing conductors, respectively;

a passivating layer on said thin-film transistor driver circuits and at least partially around said pixels and said addressing conductors; and a conductive frame on said passivating layer; and a cathode comprising:

an edge emitter material operable to emit electrons, said edge emitter material having a low work function for emitting electrons, wherein, exciting said conductive frame and addressing one of said pixels using said associated driver circuit causes said cathode to emit electrons that are directed toward a corresponding one of said pixels to induce said pixel to emit light.

2. The display of claim 1, wherein said electrically addressable pixels are coated with phosphor.

3. The display of claim 1, further comprising a substrate supporting said pixels, TFT driver circuits, passivating layer and frame.

4. The display of claim 3, wherein said substrate is transparent.

5. The display of claim 1, wherein said anode further comprises a transparent substrate supporting said pixels, TFT driver circuits, passivating layer and frame.

6. The display of claim 1, wherein said conductive frame comprises a plurality of parallel rows of conductors.

7. The display of claim 1, wherein said conductive frame comprises a plurality of parallel columns of conductors.

8. The display of claim 1, wherein said conductive frame comprises a matrix of row and column conductors defining a plurality of areas each associated with one of said pixels.

9. The display of claim 1, further comprising at least one contact pad electrically coupled to said conductive frame.

10. The display of claim 1, wherein said cathode comprises carbon nanotubes.

11. The display of claim 1, wherein each said pixel comprises a conductive pad; and said driver circuit comprises at least one transistor coupled to said conductive pad.

12. The display of claim 1, wherein:

each said pixel comprises a conductive pad; and said driver circuit comprises a first transistor coupled to said conductive pad and a second transistor and capacitor coupled to a gate of said first transistor.

13. A display comprising:

an anode comprising:

a substrate, a plurality of electrically addressable pixels supported on said substrate, a conductive addressing matrix on said substrate and electrically coupled to said pixels, and a conductive frame supported on said substrate; and, a cathode comprising:

an edge emitter material operable to emit electrons, said edge emitter material having a low work function for emitting electrons, wherein, exciting said conductive frame and addressing one of said pixels causes said cathode to emit electrons toward said addressed pixel to induce said pixel to emit light.

14. The display of claim 13, wherein said substrate is transparent.

15. The display of claim 13, further comprising a second substrate oppositely disposed from said substrate, wherein said second substrate is transparent and said light is emitted through said second substrate.

16. The display of claim 13, wherein said conductive frame comprises a matrix of row and column conductors defining a plurality of areas each associated with one of said pixels.

17. The display of claim 13, further comprising at least one contact pad electrically coupled to said conductive frame.

18. The display of claim 13, wherein said cathode comprises carbon nanotubes.

19. The display of claim 13, wherein each said pixel comprises a conductive pad and at least one transistor coupled to said conductive pad.

20. The display of claim 13, wherein each said pixel comprises a conductive pad, a first transistor coupled to said conductive pad, and a second transistor and capacitor coupled to a gate of said first transistor.

* * * * *